US010198991B2

(12) United States Patent
Lindberg et al.

(10) Patent No.: US 10,198,991 B2
(45) Date of Patent: Feb. 5, 2019

(54) COMPRESSION TECHNIQUES FOR BURN-IN STATISTICS OF ORGANIC LIGHT EMITTING DIODE (OLED) DISPLAYS

(71) Applicant: Apple Inc., Cupertino, CA (US)

(72) Inventors: Lars M. Lindberg, Bjaerred (SE); Ali Sazegari, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 9 days.

(21) Appl. No.: 15/683,606

(22) Filed: Aug. 22, 2017

(65) Prior Publication Data

US 2018/0247589 A1 Aug. 30, 2018

Related U.S. Application Data

(60) Provisional application No. 62/465,093, filed on Feb. 28, 2017.

(51) Int. Cl.
*G09G 3/3233* (2016.01)

(52) U.S. Cl.
CPC ... *G09G 3/3233* (2013.01); *G09G 2320/0233* (2013.01); *G09G 2320/046* (2013.01); *G09G 2320/0626* (2013.01)

(58) Field of Classification Search
CPC ..... G09G 3/3233; G09G 2320/0233; G09G 2320/046; G09G 2320/0626
See application file for complete search history.

(56) References Cited

U.S. PATENT DOCUMENTS 9,830,890 B2 * 11/2017 Zhou ..... H03M 7/30
2007/0229480 A1 * 10/2007 Ookawara ..... G09G 3/20 345/204
2015/0062202 A1 * 3/2015 Lu ..... H03M 7/3059 345/691
2017/0236498 A1 * 8/2017 Zhou ..... H03M 7/30 345/555
2018/0068606 A1 * 3/2018 Dighde ..... G09G 3/2003

* cited by examiner

*Primary Examiner* — Peter D McLoone
(74) *Attorney, Agent, or Firm* — Dickinson Wright RLLP

(57) ABSTRACT

Disclosed herein are techniques for pre-processing image data for compression, e.g., image data that represents burn-in statistics for a display device. The techniques can involve receiving the image data, where the image data comprises a plurality of pixels, and each pixel of the plurality of pixels comprises at least two sub-pixel values. Next, each pixel of the plurality of pixels is quantized to produce a plurality of modified pixels. Subsequently, a series of operations are performed against each modified pixel of the plurality of modified pixels, including (1) applying an invertible transformation against the modified pixel, (2) applying a predictive coding against the modified pixel, and (3) applying an encoding of the modified pixel into a buffer as a data stream. The buffer is then compressed (as the modified pixels are serially encoded into the buffer) to produce compressed outputs that are joined together to produce a compressed image.

20 Claims, 8 Drawing Sheets

Step 1 – Quantize each type of sub-pixel value

Step 2 – Apply the following invertible transformation functions to each sub-pixel value group where appropriate, e.g., :

| | |
|---|---|
| $\mathbf{C_1 = R - B}$ | [-255, 255] |
| $U = B + (C_1 >> 1)$ | [0, 255] |
| $\mathbf{D_G = G_1 - G_2}$ | [-255, 255] |
| $V = G_1 + (D_G >> 1)$ | [0, 255] |
| $\mathbf{C_2 = V - U}$ | [-255, 255] |
| $\mathbf{Y = U + (C_2 >> 1)}$ | [0, 255] |

Transform Functions 224

240

Step 3 – Apply the following predictive function to each Y sub-pixel value in each transformed sub-pixel group where appropriate, e.g., :

$$\mathbf{D_Y = Y - Y_{LEFT}}$$

COMPRESSION TECHNIQUES FOR BURN-IN STATISTICS OF ORGANIC LIGHT EMITTING DIODE (OLED) DISPLAYS

CROSS-REFERENCE TO RELATED APPLICATIONS

The present application claims the benefit of U.S. Provisional Application No. 62/465,093, entitled "COMPRESSION TECHNIQUES FOR BURN-IN STATISTICS OF ORGANIC LIGHT EMITTING DIODE (OLED) DISPLAYS," filed Feb. 28, 2017, the content of which is incorporated herein by reference in its entirety for all purposes.

FIELD OF INVENTION

The embodiments described herein set forth techniques for compressing high-resolution, multiple-channel images (e.g., red, green, and blue (RGB) images) that store burn-in statistics for display devices (e.g., organic light emitting diode (OLED) displays). In particular, the techniques involve pre-processing the images (i.e., prior to compression) in a manner that can enhance resulting compression ratios when the images are compressed using lossless compressors (e.g., Lempel-Ziv-Welch (LZW)-based compressors).

BACKGROUND

Image compression techniques involve exploiting aspects of an image to reduce its overall size while retaining information that can be used to re-establish the image to its original (lossless) or near-original (lossy) form. Different parameters can be provided to compressors to achieve performance characteristics that best-fit particular environments. For example, higher compression ratios can be used to increase the amount of available storage space within computing devices (e.g., smart phones, tablets, wearables, etc.), but this typically comes at a cost of cycle-intensive compression procedures that consume correspondingly higher amounts of power and time. On the contrary, cycle-efficient compression techniques can reduce power and time consumption, but this typically comes at a cost of correspondingly lower compression ratios and amounts of available storage space within computing devices.

Notably, new compression challenges are arising as computing device capabilities are improved through hardware and software advancements. For example, organic light-emitting diode (OLED) displays—which are becoming a popular choice for computing device displays—can degrade in a non-uniform manner over their lifespans and lead to unwanted color/brightness artifacts. To address this concern, burn-in statistics—which record historical usage information associated with a given OLED display—can be used to artificially adjust the operation of the OLED display to substantially restore visual uniformity throughout its operation. Notably, such burn-in statistics can take the form of a high-resolution, multiple-channel image that consumes a considerable amount of storage space within the computing device in which the OLED display is included. For obvious reasons, this consumption can dissatisfy users as their overall expected amount of available storage space is reduced for seemingly unknown reasons. It is therefore desirable to store the burn-in statistics in a more efficient manner.

SUMMARY OF INVENTION

Representative embodiments set forth herein disclose techniques for compressing high-resolution, multiple-channel images that store burn-in statistics for display devices. In particular, the techniques involve pre-processing the images (i.e., prior to compression) in a manner that can enhance resulting compression ratios when the images are compressed using lossless compressors.

One embodiment sets forth a method for pre-processing image data for compression (e.g., an image storing burn-in statistics for a given display device). According to some embodiments, the method can be performed by an image analyzer implemented on a computing device. Initially, the method involves receiving the image data, where the image data comprises a plurality of pixels, and each pixel of the plurality of pixels comprises at least two sub-pixel values (e.g., a red sub-pixel value, a blue sub-pixel value, a green sub-pixel value, etc.). Next, the method involves quantizing, for each pixel of the plurality of pixels, the at least two sub-pixel values to produce a plurality of modified pixels.

After the plurality of pixels are quantized, the method involves performing a series of operations against each modified pixel of the plurality of modified pixels. In particular, a first operation involves applying an invertible transformation to the at least two sub-pixel values for the modified pixel to produce an equal number of transformed sub-pixel values. A second operation involves applying a predictive coding to at least one of the transformed sub-pixel values of the modified pixel, where applying the predictive coding involves establishing a differential value by subtracting a corresponding and previously-processed sub-pixel value from the at least one of the transformed sub-pixel values. A third operation involves encoding the differential value into two corresponding bytes, and encoding each of the other transformed sub-pixel values (different from the at least one of the transformed sub-pixel values) into respective two corresponding bytes. A fourth operation involves serially storing the corresponding bytes as a data stream into a buffer. Finally, a fifth operation involves compressing the data stream in the buffer, where the outputs of the compressed data streams for each of the modified pixels are continuously joined together to produce a compressed image.

Other embodiments include a non-transitory computer readable storage medium configured to store instructions that, when executed by a processor included in a computing device, cause the computing device to carry out the various steps of any of the foregoing methods. Further embodiments include a computing device that is configured to carry out the various steps of any of the foregoing methods.

Other aspects and advantages of the invention will become apparent from the following detailed description taken in conjunction with the accompanying drawings that illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
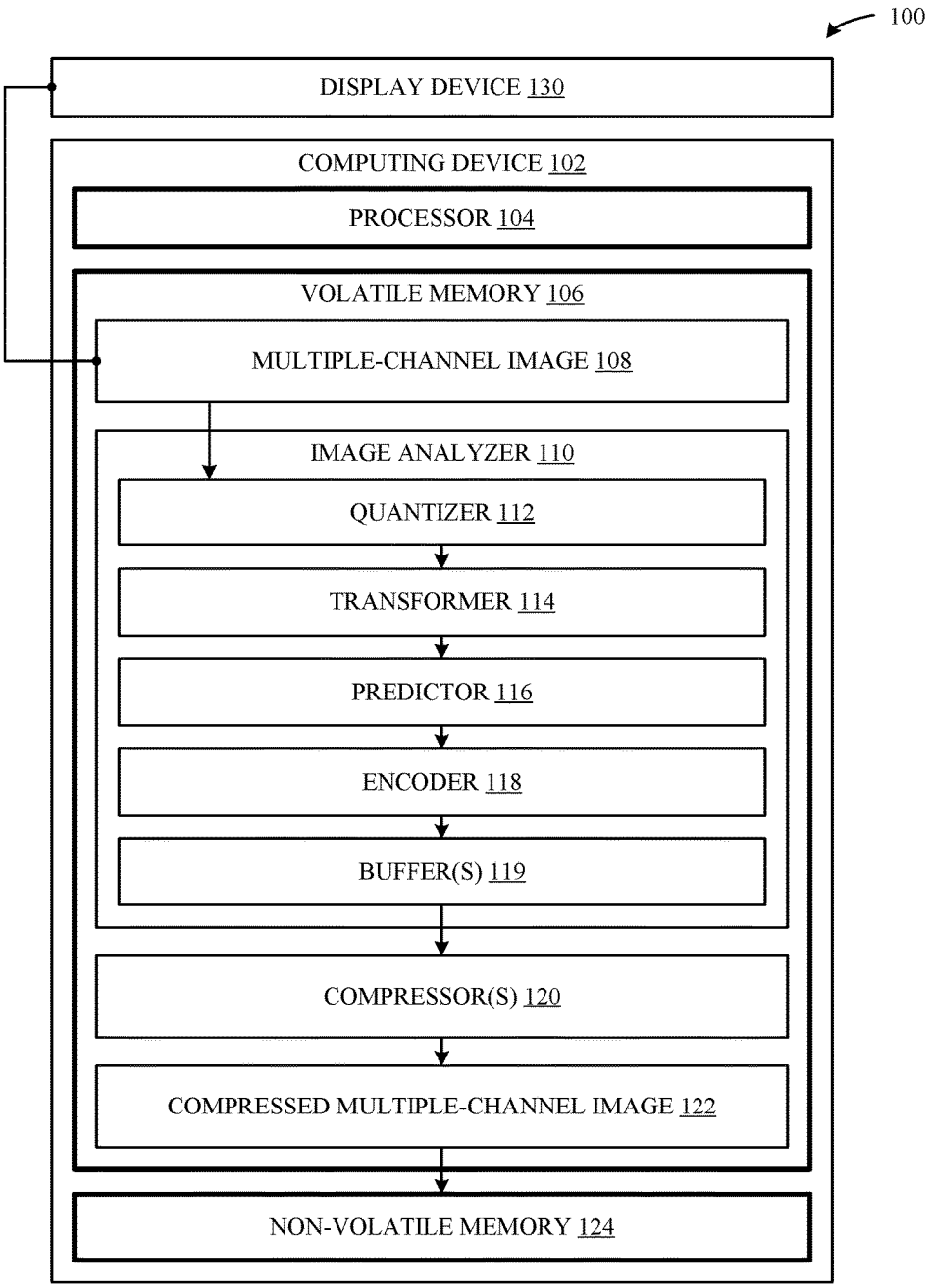
FIG. 1 illustrates an overview of a computing device that can be configured to perform the various techniques described herein, according to some embodiments.

Representative applications of methods and apparatus according to the present application are described in this section. These examples are being provided solely to add context and aid in the understanding of the described embodiments. It will thus be apparent to one skilled in the art that the described embodiments can be practiced without some or all of these specific details. In other instances, well-known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments can be used, and changes can be made without departing from the spirit and scope of the described embodiments.

The embodiments described herein set forth techniques for compressing high-resolution, multiple-channel images (e.g., 32-bit red, green, and blue (RGB) images) that store burn-in statistics for display devices (e.g., organic light emitting diode (OLED) displays). In particular, the techniques involve pre-processing the images (i.e., prior to compression) in a manner that can enhance resulting compression ratios when the images are compressed using lossless compressors (e.g., Lempel-Ziv-Welch (LZW)-based compressors).

According to some embodiments, the techniques described herein can be performed by an image analyzer implemented on a computing device. Initially, the image analyzer receives image data to be compressed, e.g., burn-in statistics for a display device, where the image data is composed of a collection of pixels. In particular, each pixel in the collection of pixels can correspond to a respective physical pixel on the display device, where a value of the pixel represents cumulative usage information for the respective physical. For example, a computing device in which the display device is included can be configured to periodically sample (e.g., once per second) the output of the display and maintain, for each physical pixel, a summation of the luminosities displayed by the physical pixel. Using this approach, the summations can be stored as the pixels within the image data. Notably, this image data can increase in size and complexity over the lifespan of the display device (as burn-in occurs), and it can be desirable to compress this image data in an efficient manner to reduce the amount of storage space needed to maintain the image data.

To achieve this goal, the image analyzer can be configured to pre-process the image data in the following manner to enhance the overall attainable compression ratio when the image data is ultimately provided to a compressor. According to some embodiments, each pixel in the collection of pixels (of the image data) corresponds to a respective group of sub-pixel values (e.g., a red sub-pixel value, a blue sub-pixel value, a green sub-pixel value, etc.). The image analyzer first quantizes, for each pixel in the collection of pixels, the sub-pixel values to produce a collection of modified sub-pixel values. According to some embodiments, the quantization of the pixels can represent a "lossy" step in which the overall accuracy of the image data is downgraded, but this can be fine-tuned/minimized by controlling the manner in which the quantization is performed, which is described below in greater detail in conjunction with FIG. 2A.

After the collection of pixels are quantized, the image analyzer performs a series of operations against each modified pixel in the collection of modified pixels. In particular, a first operation involves applying an invertible transformation to the sub-pixel values for the modified pixel to produce an equal number of transformed sub-pixel values, which is described below in greater detail in conjunction with FIG. 2B. A second operation involves applying a predictive coding to at least one of the transformed sub-pixel values of the modified pixel, where applying the predictive coding involves establishing a differential value by subtracting a corresponding and previously-processed sub-pixel value from the at least one of the transformed sub-pixel values. A detailed breakdown of this second operation is described below in greater detail in conjunction with FIG. 2C.

Next, a third operation involves encoding the differential value into two corresponding bytes, and encoding each of the other transformed sub-pixel values (different from the at least one of the transformed sub-pixel values) into respective two corresponding bytes, which is described below in greater detail in conjunction with FIG. 2D. A fourth operation involves serially storing the corresponding bytes as a data stream into a buffer, which is described below in greater detail in conjunction with FIG. 2E. And, finally, a fifth operation involves compressing the data stream in the buffer, where the outputs of the compressed data streams for each of the modified pixels are continuously joined together to produce a compressed image. A detailed breakdown of this fifth operation is also described below in greater detail in conjunction with FIG. 2E.

Accordingly, the techniques set forth herein involve pre-processing high-resolution, multi-channel images in a manner that can enhance resulting compression ratios when the images are provided to compressors (e.g., LZW-based compressors), thereby enabling computing devices to maintain highly accurate burn-in statistics while reducing the amount of required storage space. A more detailed description of these techniques is provided below in conjunction with FIGS. 1, 2A-2E, and 3-4.

Figure 4:
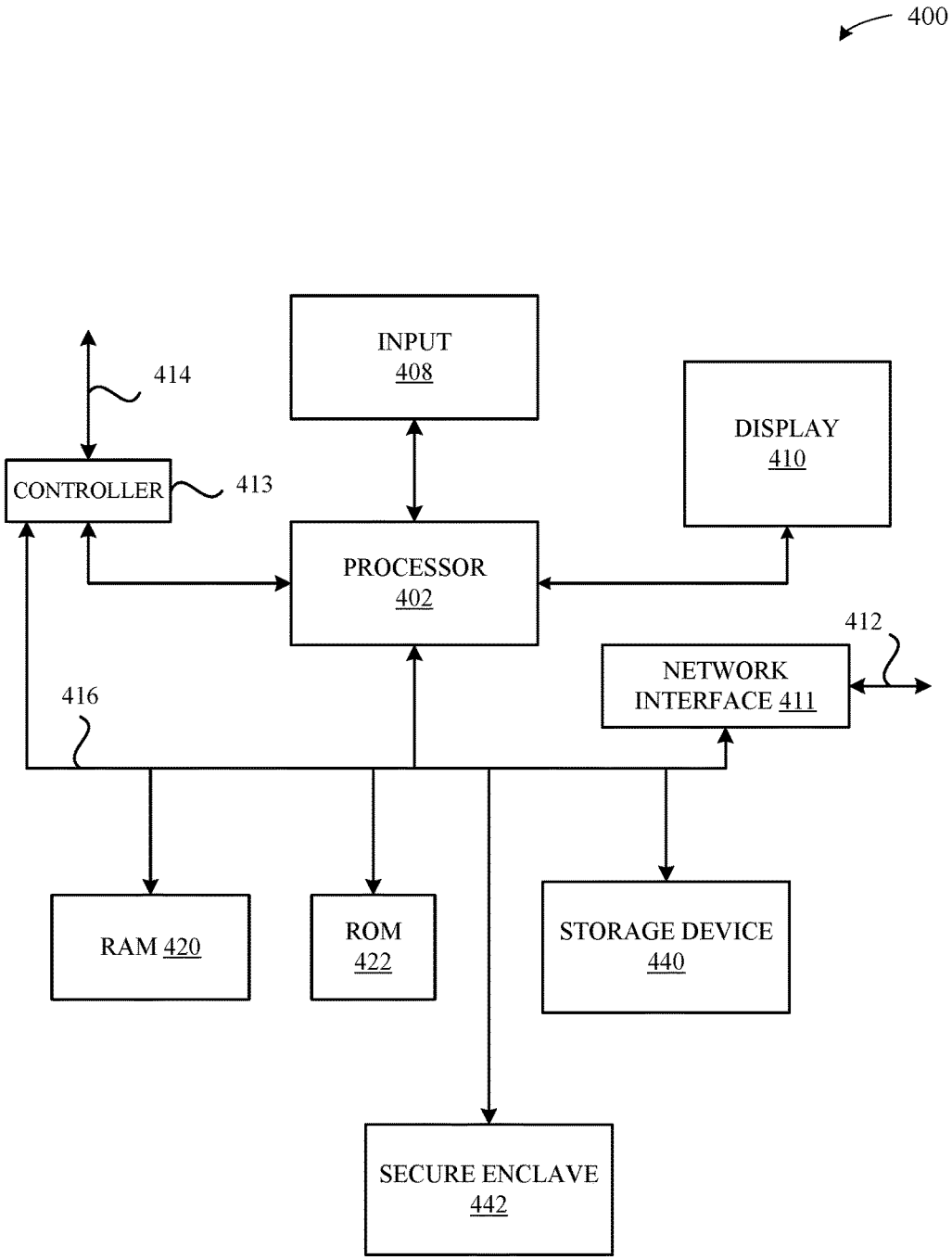
FIG. 4 illustrates a detailed view of a computing device that can be used to implement the various techniques described herein, according to some embodiments.

FIG. 1 illustrates an overview 100 of a computing device 102 that can be configured to perform the various techniques described herein. As shown in FIG. 1, the computing device 102 can include a processor 104, a volatile memory 106, and a non-volatile memory 124. It is noted that a more detailed breakdown of example hardware components that can be included in the computing device 102 is illustrated in FIG. 4, and that these components are omitted from the illustration of FIG. 1 merely for simplification purposes. For example, the computing device 102 can include additional non-volatile memories (e.g., solid state drives, hard drives, etc.), other processors (e.g., a multi-core central processing unit (CPU)), and so on. According to some embodiments, an operating system (OS) (not illustrated in FIG. 1) can be loaded into the volatile memory 106, where the OS can execute a variety of applications that collectively enable the various techniques described herein to be implemented. As described in greater detail herein, these applications can include an image analyzer 110 (and its internal components), one or more compressors 120, and so on.

According to some embodiments, the image analyzer 110 can be configured to implement the techniques described herein that involve pre-processing a high-resolution, multiple-channel image 108 prior to compressing the multiple-channel image 108. In particular, and as shown in FIG. 1, the multiple-channel image 108 can correspond to a display device 130 that is communicably coupled to the computing device 102, where the multiple-channel image 108 stores burn-in statistics for the display device 130 based on the activity of the display device 130 throughout its operating lifetime. It is noted that FIGS. 2A-2E and 3 (and the corresponding descriptions set forth below) provide a more detailed breakdown of the functionality of the image analyzer 110, and that the following description of the image analyzer 110 with respect to FIG. 1 is provided at a high level for simplification purposes.

As shown in FIG. 1, the multiple-channel image 108 is received by the image analyzer 110. According to some embodiments, and as described in greater detail herein, the multiple-channel image 108 can be composed of a collection of pixels, where each pixel in the collection of pixels includes a group of sub-pixel values (e.g., a red channel, a green channel, a blue channel, etc.). Upon receipt of the multiple-channel image 108, a quantizer 112 can be configured to quantize each pixel—more specifically, quantize the corresponding group of sub-pixel values belonging to the pixel—to produce a collection of modified pixels, which is described below in greater detail in conjunction with FIG. 2A. As previously noted herein, the quantization of the pixels can represent a "lossy" step in which the overall accuracy of the multiple-channel image 108 is downgraded, but this can be fine-tuned/minimized by controlling the configuration of the quantizer 112.

Next, each modified (i.e., quantized) pixel is provided to a transformer 114, a predictor 116, and an encoder 118, to perform a series of operations on modified pixel prior to compressing the modified pixel. In particular, the transformer 114 is configured to apply an invertible transformation to the respective group of sub-pixel values belonging to the modified pixel to produce an equal number of transformed sub-pixel values, which is described below in greater detail in conjunction with FIG. 2B. Next, the predictor 116 applies a predictive coding to at least one of the transformed sub-pixel values, which is described below in greater detail in conjunction with FIG. 2C. Subsequently, the encoder 118 distributes the bits (i.e., binary values) of the differential value into two corresponding bytes, and distributes the bits of each of the other transformed sub-pixel values (different from the at least one of the transformed sub-pixel values) into respective two corresponding bytes, which is described below in greater detail in conjunction with FIG. 2D. Finally, the corresponding bytes are placed—in a particular order—into a buffer 119 as a data stream, whereupon the compressor(s) 120 compress the data stream, which is described below in greater detail in conjunction with FIG. 2E. The outputs of the compressed data streams for each of the modified pixels are then continuously joined together to produce a compressed multiple-channel image 122, which is also described below in greater detail in conjunction with FIG. 2E.

Notably, and according to some embodiments, the compressor(s) 120 can be configured to implement one or more compression techniques for compressing the buffer(s) 119. Moreover, the compressor(s) 120 can be implemented in any manner to establish an environment that is most-efficient for compressing the buffer(s) 119. For example, multiple buffers 119 can be instantiated (where modified pixels can be pre-processed in parallel), and each buffer 119 can be tied to a respective compressor 120 such that the buffers 119 can be simultaneously compressed in parallel as well. Moreover, the same or a different type of compressor 120 can be tied to each of the buffer(s) 119 based on the inherent formatting of the content that is placed into the buffer(s) 119.

Accordingly, FIG. 1 provides a high-level overview of different hardware/software architectures that can be implemented by computing device 102 in order to carry out the various techniques described herein. A more detailed breakdown of these techniques will now be provided below in conjunction with FIGS. 2A-2E and 3-4.

Figure 2A:
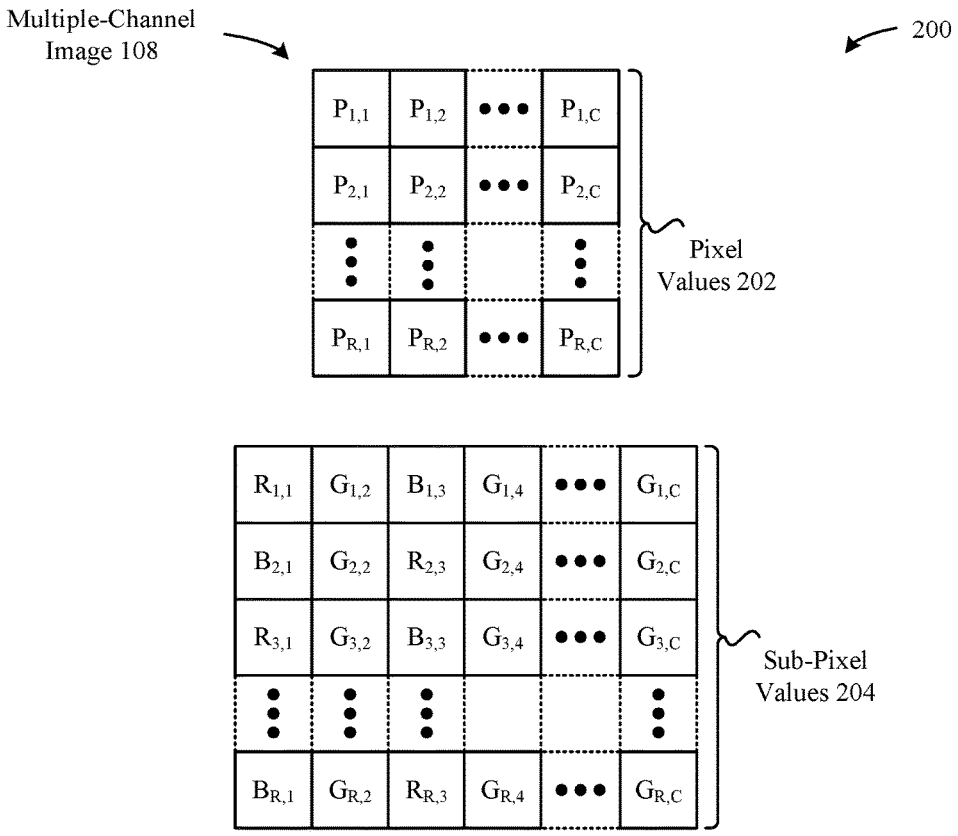
FIGS. 2A-2E illustrate a sequence of conceptual diagrams for pre-processing a high-resolution, multiple-channel image for compression, according to some embodiments
Figure 2A:
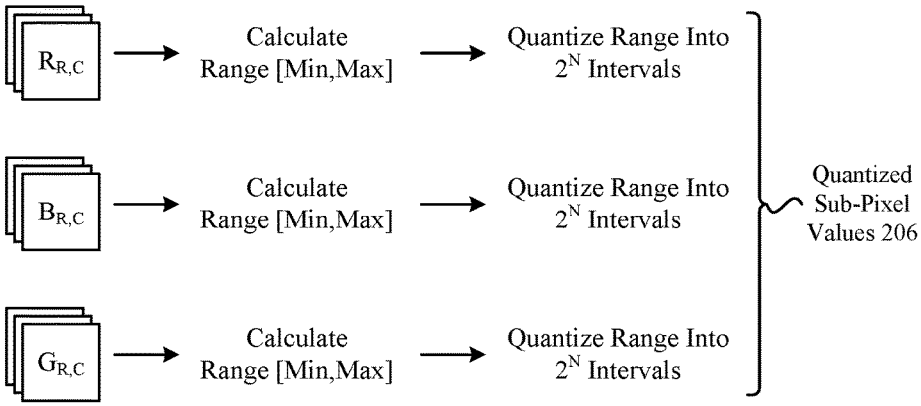

FIGS. 2A-2E illustrate a sequence of conceptual diagrams for pre-processing a high-resolution, multiple-channel image for compression, according to some embodiments. In particular, the conceptual diagrams illustrate a series of steps that the image analyzer 110 can be configured to carry out when pre-processing a multiple-channel image 108 for compression by the compressor(s) 120. For example, FIG. 2A illustrates a conceptual diagram 200 that is implemented by the quantizer 112, according to some embodiments. As shown in FIG. 2A, the multiple-channel image 108 includes a two-dimensional collection of pixel values 202 in a row and column layout, where "R" represents the row value of each pixel "P" and "C" represents the column value of each pixel "P". According to some embodiments, the pixel values 202 can be organized in accordance with a resolution/layout of a display device included in computing device 102 such that the collection of pixels can be used to store burn-in statistics associated with the display device. As also shown in FIG. 2A, the pixel values 202 can correspond to a collection of sub-pixel values 204 that are also distributed in a row/column arrangement. For example, the sub-pixel values 204 can be arranged in a red, green, blue, green (RGBG) pattern (e.g., in accordance with an organization of a video output device managed by the computing device 102). It is noted that this layout is merely exemplary, and that the embodiments set forth herein can be applied to different numbers, layouts, types, etc., of sub-pixel values 204.

As noted above, the conceptual diagram 200 illustrates how the quantizer 112 can execute a first step, Step 1, that involves quantizing the different types of sub-pixel values 204 (included within the pixel values 202). For example, when each pixel value 202 includes a red sub-pixel value 204, a green sub-pixel value 204, and a blue sub-pixel value 204, the quantizer 112 can be configured to: (1) quantize all of the red sub-pixel values 204 (of all of the pixel values 202) using a first quantizer, (1) quantize all of the green sub-pixel values 204 (of all of the pixel values 202) using a second quantizer, and (3) quantize all of the blue sub-pixel values 204 (of all of the pixel values 202) using a third quantizer. According to some embodiments, each of the first, second, and third quantizers can be configured to quantize their respective sub-pixel values 204 in accordance with a range defined by the minimum and maximum values identified across their respective sub-pixel values 204. Moreover, each of the first, second, and third quantizers can be configured with a particular quantization rate that corresponds to an acceptable level of accuracy degradation that will occur as a consequence of the quantization, e.g., eight bits per sub-pixel value 204 when each sub-pixel value 204 has a depth of thirty-two bits. It is noted that the quantizer 112 can be configured in any manner to accommodate additional types of multiple-channel images 108 having different resolutions, layouts, bit-depths, and so on, without departing from the scope of this disclosure. When the quantizer 112 completes the quantization of the sub-pixel values 204 (using the individual quantizers described above), the sub-pixel values 204 are replaced with quantized sub-pixel values 206, as illustrated in FIG. 2A.

Figure 2B:
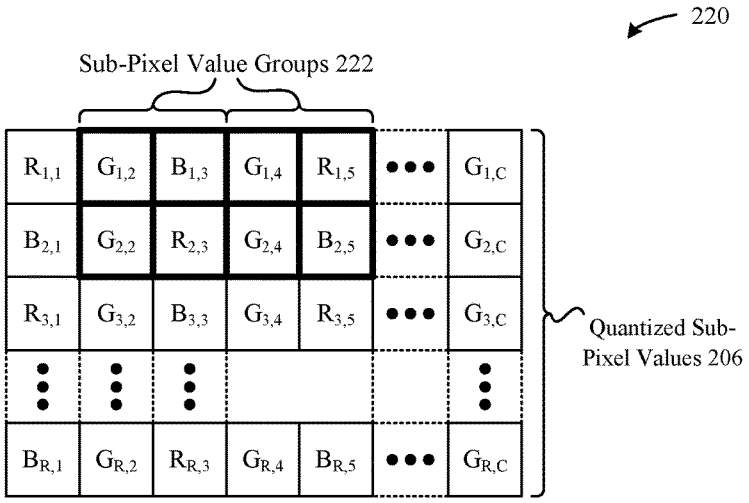
Figure 2B:
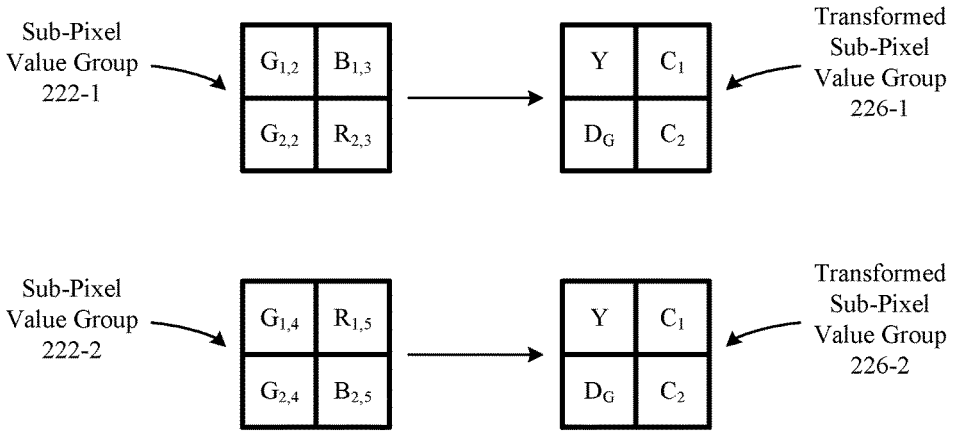

Turning now to FIG. 2B, the conceptual diagram 220 illustrates how the transformer 114 can execute a second step, Step 2, that involves performing a collection of transform functions 224 on the quantized sub-pixel values 206 (generated by the quantizer 112 in FIG. 2A). For example, the conceptual diagram 220 illustrates an example step in which two different sub-pixel value groups—sub-pixel value group 222-1 and sub-pixel value group 222-2—are converted into transformed sub-pixel value group 226-1 and transformed sub-pixel value group 226-2, respectively. As shown in FIG. 2B, the transform functions 224 can involve carrying out a series of operations on the different sub-pixel values included in each of the sub-pixel value groups 222 to produce a luma value (Y), a difference value ($D_G$), and two color values: $C_1$ and $C_2$, where these different values are calculated in accordance with the various transform functions 224 illustrated in FIG. 2B. In this manner, the overall characteristics of the multiple-channel image 108—which are fundamentally distinct from typical digital images—are transformed in a manner that enables subsequent functions to be applied to ultimately improve the compression ratio of the multiple-channel image 108.

Figure 2C:
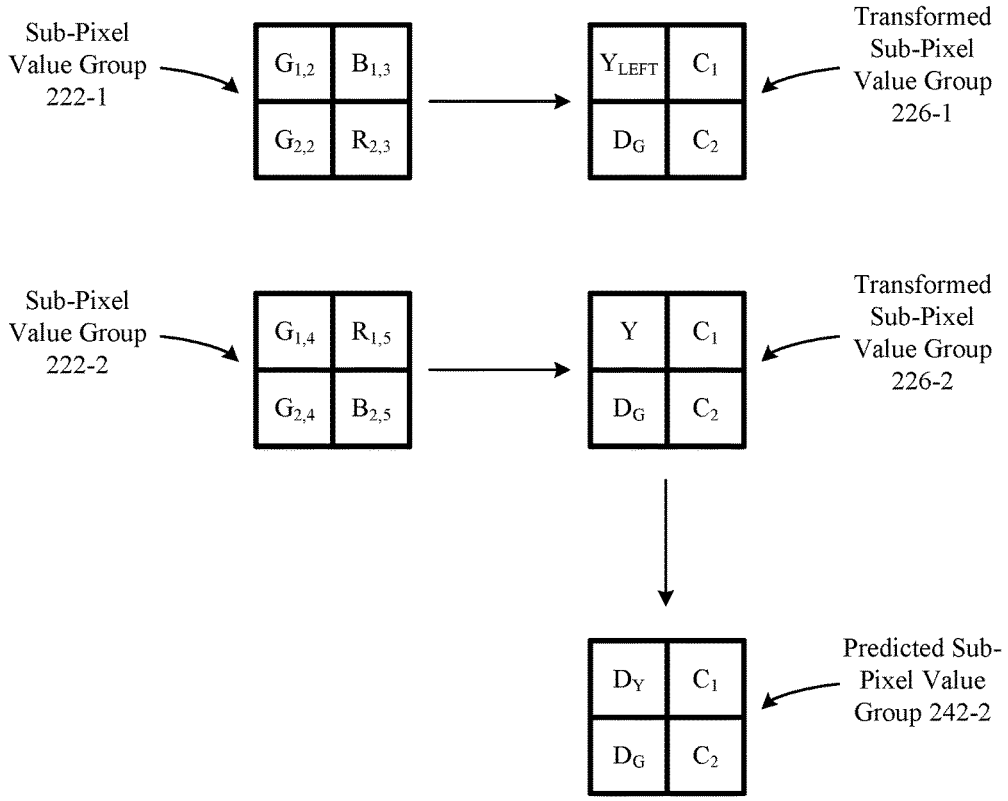

Turning now to FIG. 2C, the conceptual diagram 240 illustrates how the predictor 116 can execute a third step, Step 3, that involves performing a predictive function against the luma value (Y) included in the transformed sub-pixel value groups 226 (where appropriate). In particular, the predictor 116 can be configured to calculate a predicted luma value (Y) for the transformed sub-pixel value groups 226 that sit to the right of another transformed sub-pixel value group 226 (because the predictive function implemented by the predictor 116 involves subtracting the luma value (Y) of a transformed sub-pixel value group 226 that sits to the left of a corresponding transformed sub-pixel value group 226). An example of this scenario is illustrated in FIG. 2C, where the transformed sub-pixel value group 226-2 is converted into a predicted sub-pixel value group 242-2 (based on the respective luma values (Y) within the transformed sub-pixel value group 226-1 and the transformed sub-pixel value group 226-2), where the luma value (Y) of the transformed sub-pixel value group 226-2 is replaced with the predicted luma value D.

Figure 2D:
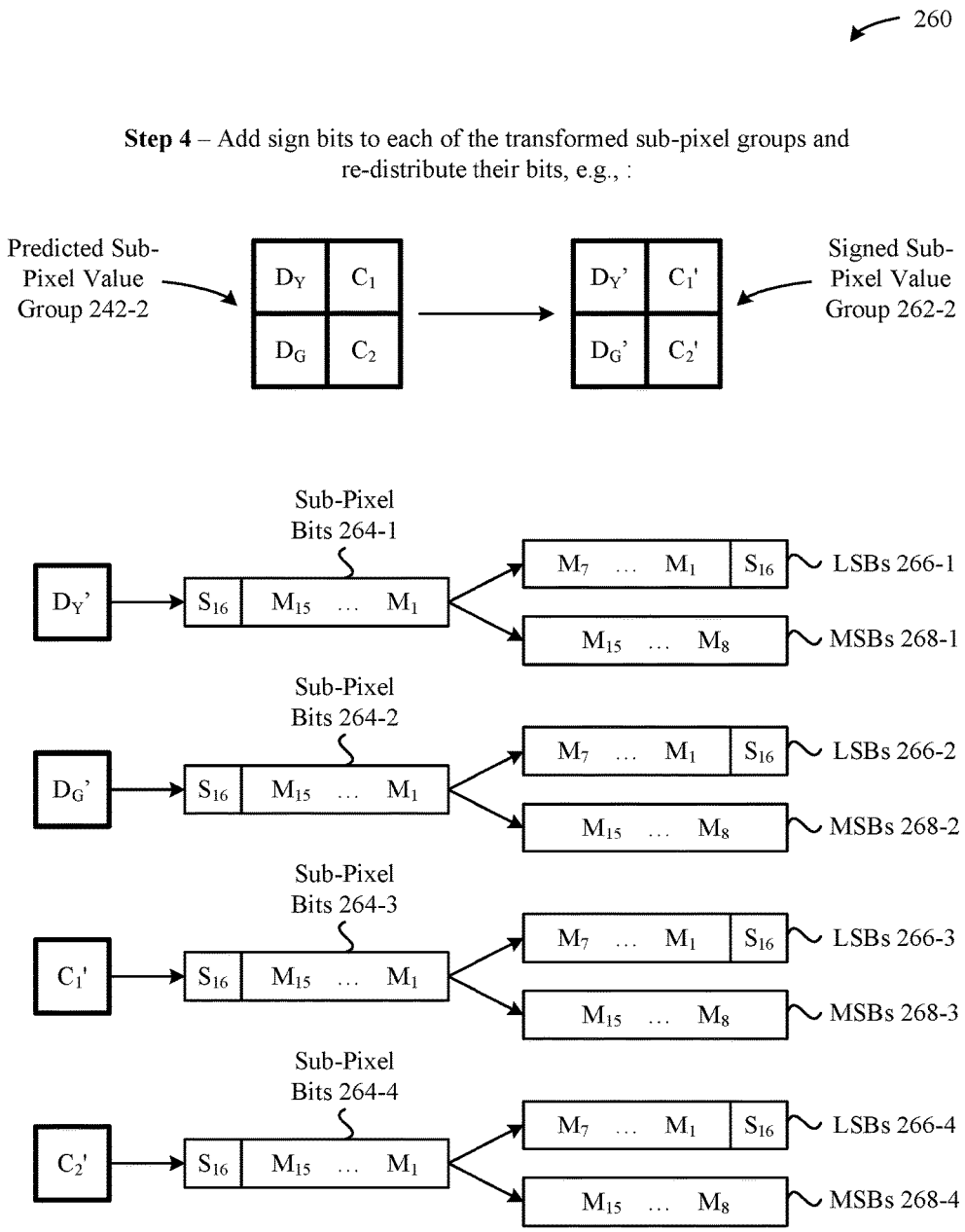

Turning now to FIG. 2D, the conceptual diagram 260 illustrates how the encoder 118 can execute a fourth step, Step 4, that involves performing an encoding operation against the predicted sub-pixel value group 242-2. As shown in FIG. 2D, the encoder 118 can expand each of the entries in the predicted sub-pixel value group 242-2 ($D_Y$, $D_G$, $C_1$, $C_2$) by adding a sign bit to produce a signed sub-pixel value group 262-2 ($D_Y'$, $D_G'$, $C_1'$, $C_2'$). For example, when the particular quantization rate described above in conjunction with FIG. 2A is less than or equal to fifteen bits, then each of the signed entries in the signed sub-pixel value group 262-2 can be represented with a length of sixteen bits: one sign bit followed by fifteen magnitude bits. This is illustrated in FIG. 2D by the different sub-pixel bits 264 that respectively correspond to the entries in the signed sub-pixel value group 262-2.

Next, the encoder 118 can be configured to separate each of the sub-pixel bits 264 into respective two corresponding bytes: least significant bytes (LSBs) 266 and most significant bytes (MSBs) 268. The encoder 118 can perform this operation using a variety of approaches, e.g., performing an in-place modification of the sub-pixel bits 264 (and ordered according to the distribution illustrated in FIG. 2D), copying the sub-pixel bits 264 to respective data structures for the MSBs 268 and the LSBs 266 (and ordered according to the distribution illustrated in FIG. 2D), and so on. In any case, as shown in FIG. 2D, the LSBs 266 can be configured to store (1) the least significant bits ($M_7$ to $M_1$) of the magnitude bits of the corresponding sub-pixel bits 264, and (2) the sign bit ($S_{16}$) of the corresponding sub-pixel bits 264. Moreover, the MSBs 268 can be configured to store the most significant bits ($M_{15}$ to $M_8$) of the corresponding sub-pixel bits 264.

Figure 2E:
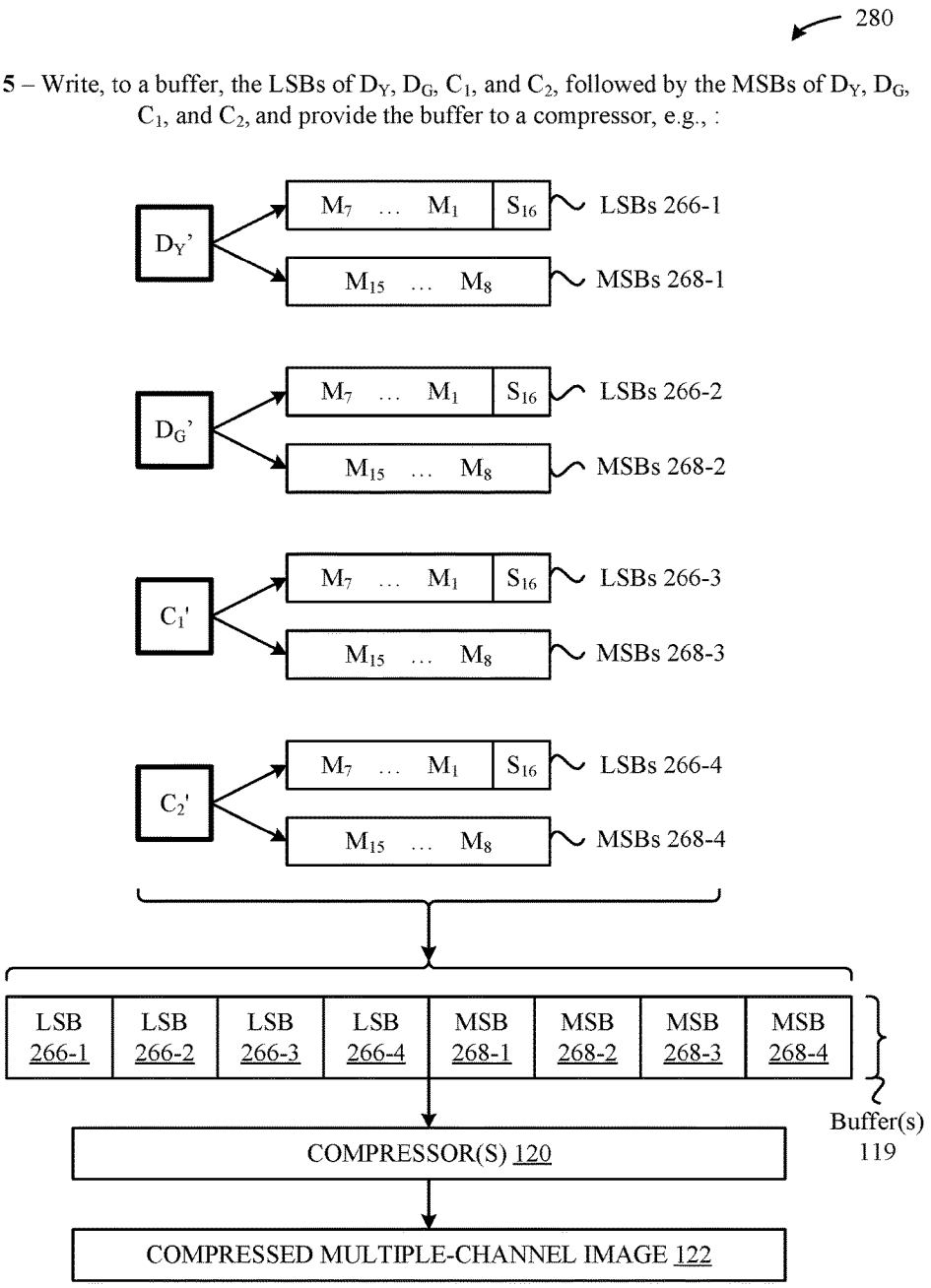

Finally, turning now to FIG. 2E, the conceptual diagram 280 illustrates how the encoder 118 can execute a fifth step, Step 5, that involves finalizing the encoding operation illustrated in FIG. 2D against the signed sub-pixel value group 262-2. As shown in FIG. 2E, the LSBs 266/MSBs 268 for each entry of the signed sub-pixel value group 262-2 can be provided to buffer(s) 119 (e.g., as a data stream) according to a particular order. In particular, the LSBs 266-1 that correspond to the entry $D_Y'$ in the signed sub-pixel value group 262-2 take the first position in the buffer(s) 119, followed by the LSBs 266-2 that correspond to the entry $D_G'$ in the signed sub-pixel value group 262-2, followed by the LSBs 266-3 that correspond to the entry $C_1'$ in the signed sub-pixel value group 262-2, and finally, followed by the LSBs 266-4 that correspond to the entry $C_2'$ in the signed sub-pixel value group 262-2. Next, these LSBs 266 in the buffer(s) 119 can be followed by the MSBs 268-1 that correspond to the entry $D_Y'$ in the signed sub-pixel value group 262-2, followed by the MSBs 268-2 that correspond to the entry $D_G'$ in the signed sub-pixel value group 262-2, followed by the MSBs 268-3 that correspond to the entry $C_1'$ in the signed sub-pixel value group 262-2, and finally, followed by the MSBs 268-4 that correspond to the entry $C_2'$ in the signed sub-pixel value group 262-2. In turn, the compressor(s) 120 can take action (e.g., when the buffer(s) 119 are filled with data) and compress the contents of the buffer(s) 119 to produce a compressed output. In this manner, the compressed outputs can be joined together (as pixel values 202 of the multiple-channel image 108 are processed in accordance with the techniques set forth in FIGS. 2A-2E and described herein) to produce a compressed multiple-channel image 122.

Figure 3:
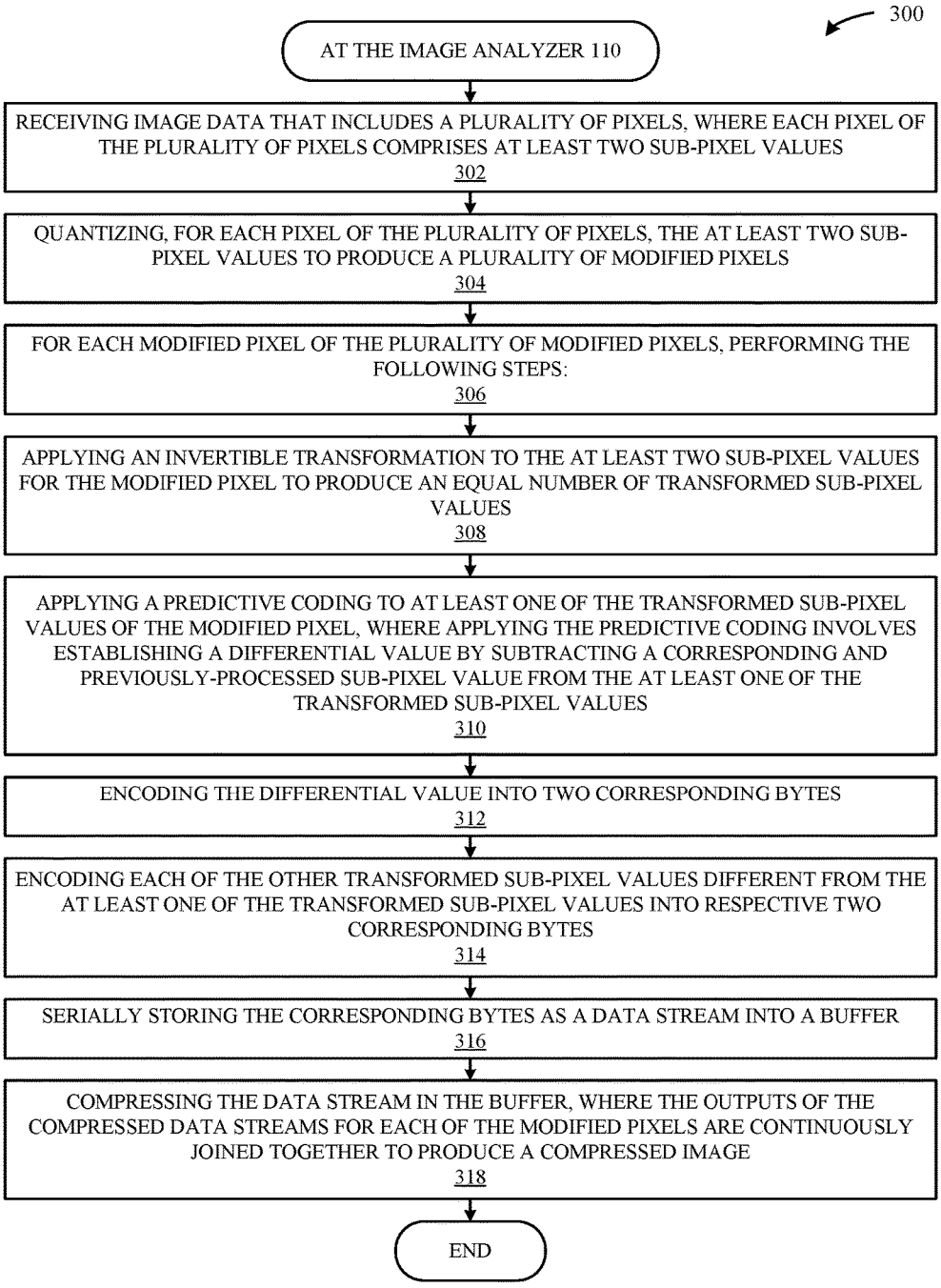
FIG. 3 illustrates a method for pre-processing a high-resolution, multiple-channel image for compression, according to some embodiments.

FIG. 3 illustrates a method 300 for pre-processing a high-resolution, multiple-channel image for compression, according to some embodiments. As shown in FIG. 3, the method 300 begins at step 302, where the image analyzer 110 receives image data that includes a plurality of pixels, and each pixel of the plurality of pixels comprises at least two sub-pixel values.

At step 304, the image analyzer 110—specifically, the quantizer 112—quantizes, for each pixel of the plurality of pixels, the at least two sub-pixel values to produce a plurality of modified pixels (e.g., as described above in Step 1 of FIG. 2A). At step 306, the image analyzer 110 performs steps 308-318 for each modified pixel of the plurality of modified pixels. In particular, at step 308, the image analyzer 110—specifically, the transformer 114—applies an invertible transformation to the at least two sub-pixel values for the modified pixel to produce an equal number of transformed sub-pixel values (e.g., as described above in Step 2 of FIG. 2B). At step 310, the image analyzer 110—specifically, the predictor 116—applies a predictive coding to at least one of the transformed sub-pixel values of the modified pixel, where applying the predictive coding involves establishing a differential value by subtracting a corresponding and previously-processed sub-pixel value from the at least one of the transformed sub-pixel values (e.g., as described above in Step 3 of FIG. 2C).

Next, at step 312, the image analyzer 110—specifically, the encoder 118—encodes the differential value into two corresponding bytes, and, at step 314, the encoder 118 encodes each of the other transformed sub-pixel values different from the at least one of the transformed sub-pixel values into respective two corresponding bytes (e.g., as described above in Step 4 of FIG. 2D). At step 316, the image analyzer 110 serially stores the corresponding bytes as a data stream into a buffer (e.g., as described above in Step 5 of FIG. 2E). Finally, at step 318, the compressor(s) 120 compress the data stream in the buffer, where the outputs of the compressed data streams for each of the modified pixels are continuously joined together to produce a compressed image (e.g., as also described above in Step 5 of FIG. 2E).

FIG. 4 illustrates a detailed view of a computing device 400 that can be used to implement the various components described herein, according to some embodiments. In particular, the detailed view illustrates various components that can be included in the computing device 102 illustrated in FIG. 1. As shown in FIG. 4, the computing device 400 can include a processor 402 that represents a microprocessor or controller for controlling the overall operation of the computing device 400. The computing device 400 can also include a user input device 408 that allows a user of the computing device 400 to interact with the computing device 400. For example, the user input device 408 can take a variety of forms, such as a button, keypad, dial, touch screen, audio input interface, visual/image capture input interface, input in the form of sensor data, and so on. Still further, the computing device 400 can include a display 410 (e.g., an OLED display) that can be controlled by the processor 402 to display information to the user. A data bus 416 can facilitate data transfer between at least a storage device 440, the processor 402, and a controller 413. The controller 413 can be used to interface with and control different equipment through and equipment control bus 416. The computing device 400 can also include a network/bus interface 411 that couples to a data link 412. In the case of a wireless connection, the network/bus interface 411 can include a wireless transceiver.

As noted above, the computing device 400 also include the storage device 440, which can comprise a single disk or a collection of disks (e.g., hard drives), and includes a storage management module that manages one or more partitions within the storage device 440. In some embodiments, storage device 440 can include flash memory, semiconductor (solid state) memory or the like. The computing device 400 can also include a Random Access Memory (RAM) 420 and a Read-Only Memory (ROM) 422. The ROM 422 can store programs, utilities or processes to be executed in a non-volatile manner. The RAM 420 can provide volatile data storage, and stores instructions related to the operation of applications executing on the computing device 102, including the image analyzers 110/154 and the compressor(s) 120.

It is additionally noted that the computing device 400 can include a secure enclave 442 that provides a highly-secure processing/storage area within the computing device 400 that is only accessible to authorized entities. In particular, the secure enclave 442 can establish a sandboxed environment in which unauthorized entities (e.g., user-level applications) are prohibited from accessing the sandboxed environment, while authorized entities (e.g., operating system (OS) daemons) are permitted to access the sandboxed environment. Accordingly, in some embodiments, all or part of the image analyzer 110 can be implemented by the secure enclave 442 to ensure that the burn-in statistics described herein are managed and stored securely and is not accessed by unauthorized entities.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium. The computer readable medium is any data storage device that can store data which can thereafter be read by a computer system. Examples of the computer readable medium include read-only memory, random-access memory, CD-ROMs, DVDs, magnetic tape, hard disk drives, solid state drives, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for pre-processing image data for compression, the method comprising, at a computing device:

receiving the image data, wherein the image data comprises a plurality of pixels, and each pixel of the plurality of pixels comprises at least two sub-pixel values;

quantizing, for each pixel of the plurality of pixels, the at least two sub-pixel values to produce a plurality of modified pixels; and for each modified pixel of the plurality of modified pixels:

applying an invertible transformation to the at least two sub-pixel values for the modified pixel to produce an equal number of transformed sub-pixel values, applying a predictive coding to at least one of the transformed sub-pixel values of the modified pixel, wherein applying the predictive coding involves establishing a differential value by subtracting a corresponding and previously-processed sub-pixel value from the at least one of the transformed sub-pixel values, encoding the differential value into two corresponding bytes, encoding each of the other transformed sub-pixel values different from the at least one of the transformed sub-pixel values into respective two corresponding bytes, serially storing the corresponding bytes as a data stream into a buffer, and compressing the data stream in the buffer.

2. The method of claim 1, wherein the at least two sub-pixel values include a blue sub-pixel value and a red sub-pixel value, and applying the invertible transformation comprises:

subtracting the blue sub-pixel value from the red sub-pixel value to produce a difference, and replacing the blue sub-pixel value with the difference.

3. The method of claim 1, wherein the at least two sub-pixel values include a first green sub-pixel value and a second green sub-pixel value, and applying the invertible transformation comprises:

subtracting the second green sub-pixel value from the first green sub-pixel value to produce a difference, and replacing the second green sub-pixel value with the difference.

4. The method of claim 1, wherein corresponding sub-pixel values of the plurality of pixels are quantized using a different quantizer.

5. The method of claim 1, wherein:

the differential value is comprised of sixteen bits, wherein one bit of the sixteen bits is a sign bit, and fifteen of the sixteen bits are magnitude bits, and encoding the differential value into two corresponding bytes comprises:

placing, into a first byte of the two corresponding bytes, seven of the least significant bits of the magnitude bits, followed by the sign bit, and placing, into a second byte of the two corresponding bytes, eight of the most significant bits of the magnitude bits.

6. The method of claim 5, wherein serially storing the corresponding bytes as the data stream into the buffer comprises:

serially placing the first bytes of each of the two corresponding bytes into a leading position within data stream, and serially placing the second bytes of each of the two corresponding bytes into a trailing position within the data stream.

7. The method of claim 1, wherein compressing the data stream in the buffer produces a compressed output, and the compressed outputs for each modified pixel of the plurality of modified pixels are combined together to produce a compressed image.

8. A non-transitory computer readable storage medium configured to store instructions that, when executed by a processor included in a computing device, cause the computing device to pre-process image data for compression, by carrying out steps that include:

receiving the image data, wherein the image data comprises a plurality of pixels, and each pixel of the plurality of pixels comprises at least two sub-pixel values;

quantizing, for each pixel of the plurality of pixels, the at least two sub-pixel values to produce a plurality of modified pixels; and for each modified pixel of the plurality of modified pixels:

applying an invertible transformation to the at least two sub-pixel values for the modified pixel to produce an equal number of transformed sub-pixel values, applying a predictive coding to at least one of the transformed sub-pixel values of the modified pixel, wherein applying the predictive coding involves establishing a differential value by subtracting a corresponding and previously-processed sub-pixel value from the at least one of the transformed sub-pixel values, encoding the differential value into two corresponding bytes, encoding each of the other transformed sub-pixel values different from the at least one of the transformed sub-pixel values into respective two corresponding bytes, serially storing the corresponding bytes as a data stream into a buffer, and compressing the data stream in the buffer.

9. The non-transitory computer readable storage medium of claim 8, wherein the at least two sub-pixel values include a blue sub-pixel value and a red sub-pixel value, and applying the invertible transformation comprises:

subtracting the blue sub-pixel value from the red sub-pixel value to produce a difference, and replacing the blue sub-pixel value with the difference.

10. The non-transitory computer readable storage medium of claim 8, wherein the at least two sub-pixel values include a first green sub-pixel value and a second green sub-pixel value, and applying the invertible transformation comprises:

subtracting the second green sub-pixel value from the first green sub-pixel value to produce a difference, and replacing the second green sub-pixel value with the difference.

11. The non-transitory computer readable storage medium of claim 8, wherein corresponding sub-pixel values of the plurality of pixels are quantized using a different quantizer.

12. The non-transitory computer readable storage medium of claim 8, wherein:

the differential value is comprised of sixteen bits, wherein one bit of the sixteen bits is a sign bit, and fifteen of the sixteen bits are magnitude bits, and encoding the differential value into two corresponding bytes comprises:

placing, into a first byte of the two corresponding bytes, seven of the least significant bits of the magnitude bits, followed by the sign bit, and placing, into a second byte of the two corresponding bytes, eight of the most significant bits of the magnitude bits.

13. The non-transitory computer readable storage medium of claim 12, wherein serially storing the corresponding bytes as the data stream into the buffer comprises:

serially placing the first bytes of each of the two corresponding bytes into a leading position within data stream, and serially placing the second bytes of each of the two corresponding bytes into a trailing position within the data stream.

14. The non-transitory computer readable storage medium of claim 8, wherein compressing the data stream in the buffer produces a compressed output, and the compressed outputs for each modified pixel of the plurality of modified pixels are combined together to produce a compressed image.

15. A computing device configured to pre-process image data for compression, the computing device comprising:

a processor; and a memory configured to store instructions that, when executed by the processor, cause the computing device to:

receive the image data, wherein the image data comprises a plurality of pixels, and each pixel of the plurality of pixels comprises at least two sub-pixel values;

quantize, for each pixel of the plurality of pixels, the at least two sub-pixel values to produce a plurality of modified pixels; and for each modified pixel of the plurality of modified pixels:

apply an invertible transformation to the at least two sub-pixel values for the modified pixel to produce an equal number of transformed sub-pixel values, apply a predictive coding to at least one of the transformed sub-pixel values of the modified pixel, wherein applying the predictive coding involves establishing a differential value by subtracting a corresponding and previously-processed sub-pixel value from the at least one of the transformed sub-pixel values, encode the differential value into two corresponding bytes, encode each of the other transformed sub-pixel values different from the at least one of the transformed sub-pixel values into respective two corresponding bytes, serially store the corresponding bytes as a data stream into a buffer, and compress the data stream in the buffer.

16. The computing device of claim 15, wherein the at least two sub-pixel values include a blue sub-pixel value and a red sub-pixel value, and applying the invertible transformation comprises:

subtracting the blue sub-pixel value from the red sub-pixel value to produce a difference, and replacing the blue sub-pixel value with the difference.

17. The computing device of claim 15, wherein the at least two sub-pixel values include a first green sub-pixel value and a second green sub-pixel value, and applying the invertible transformation comprises:

subtracting the second green sub-pixel value from the first green sub-pixel value to produce a difference, and replacing the second green sub-pixel value with the difference.

18. The computing device of claim 15, wherein:

the differential value is comprised of sixteen bits, wherein one bit of the sixteen bits is a sign bit, and fifteen of the sixteen bits are magnitude bits, and encoding the differential value into two corresponding bytes comprises:

placing, into a first byte of the two corresponding bytes, seven of the least significant bits of the magnitude bits, followed by the sign bit, and placing, into a second byte of the two corresponding bytes, eight of the most significant bits of the magnitude bits.

19. The computing device of claim 18, wherein serially storing the corresponding bytes as the data stream into the buffer comprises:

serially placing the first bytes of each of the two corresponding bytes into a leading position within data stream, and serially placing the second bytes of each of the two corresponding bytes into a trailing position within the data stream.

20. The computing device of claim 15, wherein compressing the data stream in the buffer produces a compressed output, and the compressed outputs for each modified pixel of the plurality of modified pixels are combined together to produce a compressed image.

* * * * *